US006307339B1

(12) United States Patent
Yourist et al.

(10) Patent No.: US 6,307,339 B1
(45) Date of Patent: Oct. 23, 2001

(54) BI-DIRECTIONALLY DYNAMICALLY BRAKED GATE CROSSING MECHANISM CONTROLLER

(75) Inventors: Rodney L. Yourist, Des Plaines; Robert W. Wardzala, Belvedere, both of IL (US)

(73) Assignee: Western-Cullen-Hayes, Inc., Chicago, IL (US)

( * ) Notice: Subject to any disclaimer, the term of this patent is extended or adjusted under 35 U.S.C. 154(b) by 0 days.

(21) Appl. No.: 09/274,215

(22) Filed: Mar. 23, 1999

Related U.S. Application Data

(60) Provisional application No. 60/109,575, filed on Nov. 23, 1998.

(51) Int. Cl.[7] ..... B61L 29/08

(52) U.S. Cl. ..... 318/266; 318/286; 318/375; 318/380

(58) Field of Search ..... 318/264, 265, 318/266, 286, 362, 466–469, 372, 375, 614, 293, 376

(56) References Cited

U.S. PATENT DOCUMENTS

| | | | | |
|---|---|---|---|---|
| 3,601,603 | * | 8/1971 | Hughson | 181/293 |
| 5,502,367 | * | 3/1996 | Jones | 181/293 |
| 5,747,954 | * | 5/1998 | Jones et al. | 318/286 |

* cited by examiner

*Primary Examiner*—Khanh Dang
(74) *Attorney, Agent, or Firm*—Banner & Witcoff, Ltd.

(57) ABSTRACT

The output voltage of a D.C. motor used to raise and lower a railroad crossing gate is monitored to detect when the D.C. motor begins to generate power, indicating that the motor is being driven by a rising gate arm. If the motor generates power above a adjustable predetermined value, the gate arm mechanism is considered to be operating too fast whereupon an impedance is shunted across the motor's armature thereby applying a load to the generating motor. The electrical load causes the motor to act as a dynamic brake slowing the gate arm mechanism operation and reducing the likelihood that the mechanical components of the crossing gate arm mechanism will be damaged.

42 Claims, 4 Drawing Sheets

300
302
304
306
310
312
314
316
318
318A
318B
320
322
324
326
328
330
332
334
336
202
+Urau
+6Ua
SET
RESET
12V

BI-DIRECTIONALLY DYNAMICALLY BRAKED GATE CROSSING MECHANISM CONTROLLER

This application is a continuation of, and claims the benefit of the filing date of U.S. application Ser. No. 60/109,575, filed Nov. 23, 1998 for a "Crossing Guard Gate Controller" which was assigned to the Assignee of this application.

BACKGROUND OF THE INVENTION

This invention relates to automatic gate crossing mechanisms. In particular, this invention relates to automatic railroad gate crossing mechanisms.

Prior art railroad crossing gates mechanisms are well known. Upon the approach of a train at a roadway crossing (where railroad tracks and a roadway intersect) these ubiquitous mechanisms automatically lower a gate across a highway or road impeding the passage of vehicular and/or pedestrian traffic across the railroad tracks. When the train passes, the mechanism automatically lifts the gate.

Most gate control mechanisms use a D.C. motor to raise and lower the gate arm because the operating characteristics of D.C. motors make them ideally suited for such an application. Most of these D.C. motors are small, fractional or low horsepower motors because the gate arm is counterweighted by an appropriate counterweight. The motor is typically coupled to the gate arm through a torque-multiplying transmission or gear box reducing the amount of torque required to rotate the arm between the raised and lowered positions.

In most gate control mechanisms, a series/shunt type D.C. motor is used. All D.C. motors are reversible, have a high starting and running torque and the armature voltage readily controls its speed. The D.C. motor is typically coupled to the gate arm through a torque-multiplying transmission or gearbox. Balancing the gate arm using a counterweight system reduces the power required to raise and lower the gate—even when using a torque-multiplying gearbox.

To lower a crossing gate, the D.C. motor of a railroad gate crossing mechanism, which is coupled to a transmission or gear box, causes a crossing gate held in an "up" position to rotate downward through a predetermined angular arc. Cam-actuated limit switches cut off power to the motor so as to limit the motors' travel as the gate lowers. To raise the gate, the motor rotation direction is reversed causing the transmission to reverse direction thereby lifting the gate upward. Other limit switches and/or cam-actuated switches stop the motor as the gate reaches its full "up" position. To reduce costs, gate travel direction control is preferably achieved by simply reversing the D.C. motor instead of using the aforementioned transmission and/or gearbox.

In the course of lowering the gate arm using the motor, after the motor is energized to lower the gate arm, the gate arm begins to rotate in a downward direction and soon begins to experience an increasingly strong, downward gravitational force. As the gate arm rotates it continues to accelerate under the influence of gravity to a point where assistance from the motor is no longer necessary. Well before the gate is fully horizontal, power is cut off from the motor and only only the force of gravity lowers the gate arm. In fact, the downward travel of a properly counterweighted gate arm accelerates at such a rate such that the gate arm can be damaged when the gate arm drops to its horizontal position, i.e. when the gate arm is substantially parallel to the roadway surface, if the downward falling gate arm is not braked to slow the gate arm.

Another characteristic of a D.C. motors is it's ability to dynamically brake itself.

A unique characteristic of a D.C. motor is that it will act as a generator, producing a D.C. output current and voltage across the armature, if the armature is mechanically driven by an external mechanical power source. Prior art gate control mechanisms use this characteristic of a D.C. motor to dynamically brake the falling gate arm when the gate arm drops to some predetermined angular inclination with respect to the ground. Dynamic braking in the downward gate-travel direction is achieved by monitoring the angle of inclination of the gate arm. At some predetermined angle of inclination of the gate arm, and when the motor begins to act as a generator, cam operated switches apply an impedance across the armature impressing an electrical (and hence mechanical) load upon the generator. By appropriately selecting the value of the impedance used to shunt the armature the electrical and mechanical load on the generator can be adjusted to adjust the amount of braking effect produced by the generator. In fact, using dynamic braking, the gate arm travel rate can be slowed whereby the gate arm is not damaged as it falls to its downward position.

While downward travel dynamic braking is well known, prior art gate control mechanisms do not provide any upward travel dynamic braking. It is well known that railroad crossing gates are frequently damaged or broken when in the "down" position. When a railroad crossing gate is broken off when in the down position, the previously balanced gate arm suddenly becomes unbalanced. The unbalanced gate arm system will accelerate at an uncontrolled rate to the up position simply because of the weight of the arm's counterweight. Uncontrolled upward acceleration of the gate arm mechanism can damage the gate arm mechanism as the mechanism is suddenly forced to stop in the "up" position. Uncontrolled upward acceleration of the gate can also be present in normal operation of so-called fail clear gate mechanisms. That is a gate mechanism in which when a failure occurs the over-counterweighted system forces the gate to the up position.

A gate control arm mechanism which brakes the travel of a gate arm in both the upward and downward directions so as to avoid inadvertent damage to a gate control arm mechanism that might be caused by sudden and uncontrolled upward acceleration would be an improvement over the prior art. Braking a gate control arm mechanism as it travels to an up position preferably limits the gate's control arm up velocity to a maximum rate below which the gate control mechanism will not be damaged.

SUMMARY OF THE INVENTION

A railroad gate control mechanism is dynamically braked by a D.C. drive motor in both a downward and an upward direction by monitoring the speed of a D.C. motor used to raise and lower the gate arm. When a D.C. motor used in a gate control mechanism begins to act as generator so as to generate an output voltage, the motor, and hence the gate arm, can be dynamically braked by applying a shunt impedance across the output of the armature. Unlike prior art devices which brake gate arm travel in only one direction, the gate arm mechanism and controller disclosed herein is dynamically braked in both directions. The impedance across the motor, acting as a generator, imposes a load upon the generator thereby retarding the rotation of the erstwhile motor.

Dynamic braking a gate traveling in the upward direction prevents the gate control mechanism from being damaged if the gate is broken and the gate arm counterweight accelerates downward uncontrollably or in the case of a fail clear gate mechanism allows the gate to operate normally, or fail, to the up position without causing damage to the gate mechanism. Continuously monitoring the motor's armature speed or voltage and appropriately shunting an impedance across the armature effectively provides dynamic braking. If the motor's armature speed or voltage exceeds a predetermined threshold, indicating that the gate is traveling upward in excess of a predetermined rate, an impedance impressed across the armature provides an electrical and hence mechanical load on the "generator" dynamically braking it.

DETAILED DESCRIPTION OF THE PREFERRED EMBODIMENT

Figure 1:
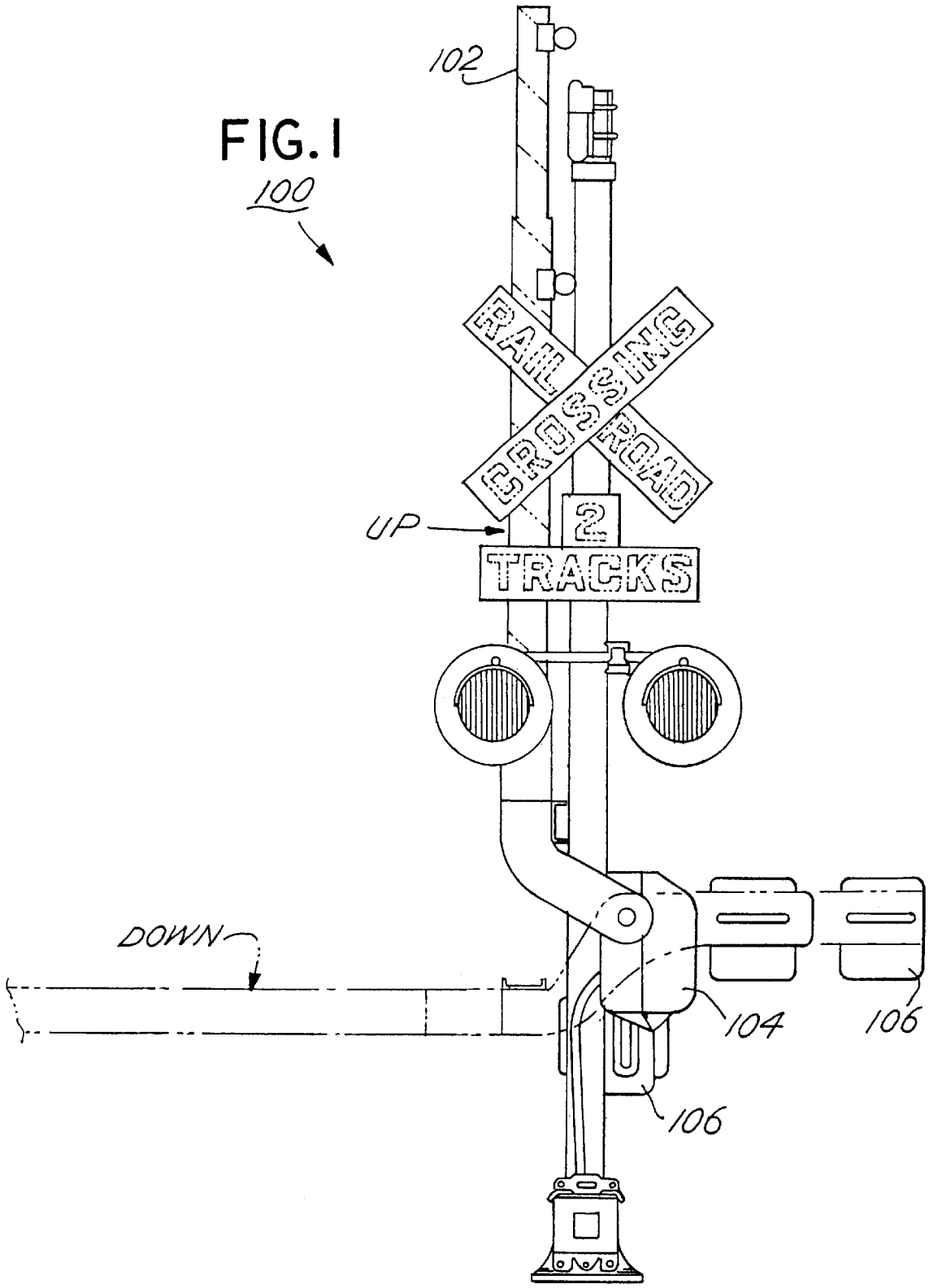
FIG. 1 is a simplified block diagram of the functional elements of the invention including a gate motor armature voltage sensor and an armature shunt impedance.

FIG. 1 shows a perspective view of a railroad crossing gate 100 comprised of a railroad crossing gate arm 102 coupled to a gate arm controller mechanism 104 which bi-directionally brakes the crossing gate arm travel movement. A counterweight 106 counteracts the weight of the gate arm 102 reducing the amount of mechanical power required of the motor in the gate arm controller mechanism to raise and lower the gate arm 102 thereby making it feasible to use less-costly fractional or low horsepower motors.

The railroad crossing gate 100 as depicted in FIG. 1 shows the railroad gate arm in an "up" position. To lower the gate arm, power is applied to a D.C. motor (not shown but within the gate arm controller mechanism 104) causing the gate to begin to rotate downward. Cam-operated limit switches within the controller mechanism 104 cut-off power to the motor when the gate arm's inclination angle is below a predetermined level. As the counterweighted gate arm 102 is accelerated downward by gravity, the drive motor within the controller mechanism 104 might begin acting as a generator, at which point an impedance can be shunted across the motor's armature dynamically braking further downward travel of the gate arm 102.

As described in the Background of the Invention, when the gate 102 is in a down position 108 and broken off (by a vehicle or vandals for example) the counterweight 106 can cause the gate arm mechanism 104 to be forced to travel upward uncontrollably and possibly damaging the controller mechanism 104, or when a fail clear gate mechanism is employed which normal operation causes the counterweights 106 to provide the gate arm lifting means. In such an event, a dynamic brake to control the upward gate travel velocity can prevent damage to the expensive transmission and/or gearbox used in the gate controller mechanism 104.

Figure 2:
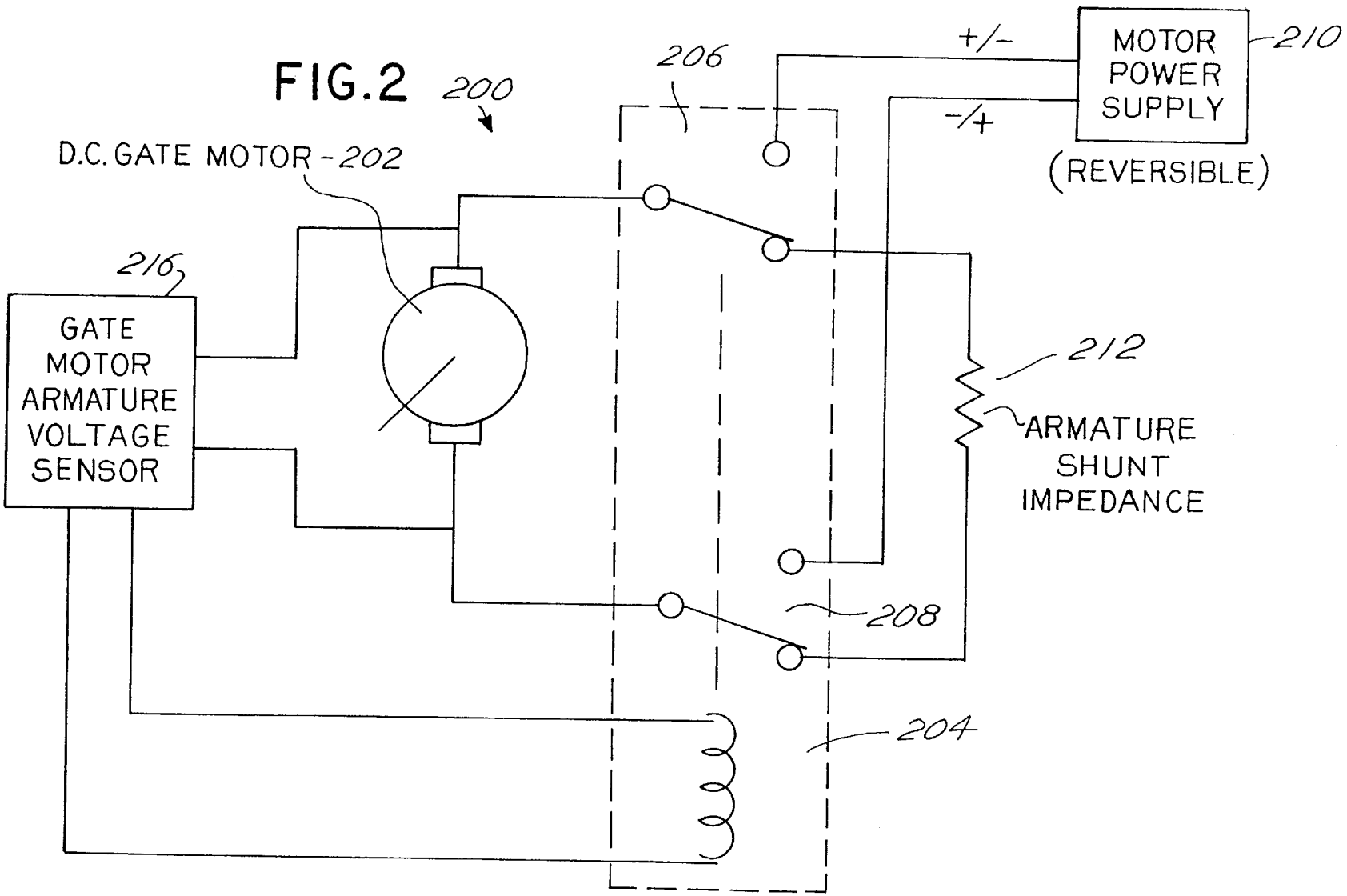
FIG. 2 is an electrical schematic diagram of the preferred embodiment of the gate motor armature voltage sensor circuit.

FIG. 2 shows a simplified block diagram of some of the electrical controls of a gate arm controller mechanism, such as the gate control mechanism 104 shown in FIG. 1 and which is capable of dynamically braking the crossing gate arm. The gate arm controller mechanism 104 of FIG. 1—and the controller mechanism depicted in FIG. 2—includes a D.C. gate motor 202. The D.C. gate motor 202 is a D.C. motor, typically of low or fractional horsepower. A relay 204 couples the D.C. gate motor 202 to a motor power supply 210 through one or more relay contact sets such as 206 and 208. Form C, single pole, double throw type contacts are required because the polarity of the D.C. power applied to the motor 202 must be reversed to reverse the motor's direction. The relay 204 controls the polarity of power applied to the motor, and also alternatively couples the armature terminals of the gate motor 202 to an armature shunt impedance, 212, during normal gate down operation.

Because the gate motor must raise and lower the gate arm, its direction of rotation is changed accordingly. The motor's direction is controlled by the control relay 204 which switches polarity of the power supply 210 applied to the motor 202. Controlling the rotation direction of a D.C. motor in a railroad crossing gate controller so as to raise and lower a gate is well-known prior art. For simplicity, the electrical components by which the motor 202 is reversed are depicted as the motor power supply 210, supplies power to the relay contacts 206 and 208 to necessarily switch polarity to change the rotation direction of the gate motor 202. From the motor's 202 perspective, the power supplied will be of one polarity to lower the gate arm and an opposite polarity to raise the gate arm. Alternate embodiments that raise and lower a gate but using a motor that does not reverse its rotation would of course require a power transmission mechanism by which the uni-directional motor rotation could be reversed to provide bi-directional gate arm travel.

Power applied to the gate motor 202 from the motor power supply 210, is controlled using the aforementioned prior art switch contacts and/or relays (not all shown but many of which are cam actuated) so as to cause the gate motor to energize to bring the gate arm down when a train approaches a crossing grade. Similarly, the same or other relays and/or control contacts cause the motor to reverse raising the gate arm after a train has cleared a crossing grade.

A gate motor armature voltage or speed sensor 216 is shown in FIG. 2 coupled across the armature contacts of the gate motor 202. The purpose of the gate motor armature voltage sensor 216 is to reliably monitor the magnitude of the speed or voltage across the armature contacts of the gate motor 202. The voltage across the armature contacts of the motor is proportional to, and therefor provides a measure of the motor's speed. When a voltage is applied to the armature, the motor will rotate. Those skilled in the art know that a D.C. motor will behave as a generator, producing an output voltage at the armature if the armature is rotated by an external mechanical force. Stated alternatively, a D.C. motor will act as a D.C. generator when it is driven by a mechanical power source. The magnitude of the output voltage produced by the generating motor is directly proportional to the rotational speed of the generating motor. As the generating motor turns faster, its output voltage increases. An electrical load impressed upon the generating motor's output will mechanically "load" the generator, tending to slow its rotation.

The gate motor armature voltage sensor 216 continuously monitors the gate motor 202 to detect when the gate motor 202 begins acting as a generator. If the voltage across the armature terminals of the gate motor 202 exceeds a predetermined threshold value, the gate motor armature voltage sensor determines that the gate motor is being driven to operate as a generator. When the output voltage of the gate motor 202 exceeds the threshold value, the gate motor armature voltage sensor 216 energizes the windings of it's internal relay causing the relay contacts 206 and 208 to change state so as to shunt the armature terminals of the gate motor 202 with the impedance 212. (Whether or not the relay 204 must be energized or de-energized to shunt an impedance across the armature of the motor 202 is a design choice.) Unlike prior art devices, which used a surge suppressor to apply dynamic braking in the upward direction, and which is unpredictable in operation, the precise voltage sensor of the present invention reliably and predictably applies dynamic braking in both directions of gate arm travel.

In an alternate embodiment, motor speed might also be sensed by an external sensing device such as a magnetic pick-up device, using a Hall-effect sensor, an optoelectronic sensor, resolver or a rotary variable differential transformer. Such alternate speed sensors of course need to be operatively coupled to the motor so as to sense its speed. They also need to produce some output signal capable of triggering the application of a braking mechanism or circuit to slow the motor's rotation. The alternate speed sensors listed above, readily produce an output signal detectable by analog or digital circuitry, which in turn can be employed to actuate either a mechanical brake or apply a resistance to the motor armature to dynamically brake it.

With the impedance 212 shunted across the armature terminals of the gate motor 202, current flows through the shunt impedance 212 creating an opposing magnetic field/EMF in the armature, thereby mechanically opposing the rotation of the armature of the gate motor 202 and dynamically braking the rotation of the armature of the motor 202. Rotation of a transmission and/or gearbox to which the gate arm is connected is decelerated.

The D.C. gate motor 202 will act as a generator when it is being mechanically rotated by, or from an external mechanical force. This typically occurs under three conditions: (1) when the railroad gate arm is traveling downward under the pull of gravity— characteristically after the gate arm is initially powered to lower the gate and (2) in the event that a gate arm in the down or lowered position is broken off the counterweights depicted in FIG. 1 will cause the D.C. gate motor 202 to act as a generator in the opposite direction, and (3) during the normal or faulted operation of a gate mechanism designed to fail in the clear or up position. By monitoring the output voltage of the D.C. gate motor 202, and applying the shunt impedance 212 whenever the output voltage of the gate motor 202 exceeds an adjustable predetermined threshold value, the gate arm is dynamically braked through the motor whenever the motor rotational speed exceeds a adjustable, predetermined value. Dynamic braking in both the upward and downward directions is achieved reducing the likelihood that the gate controller mechanism 104 and its constituent parts might be damaged by the gate arm uncontrollably slamming into its "up" or down position.

Figure 3:
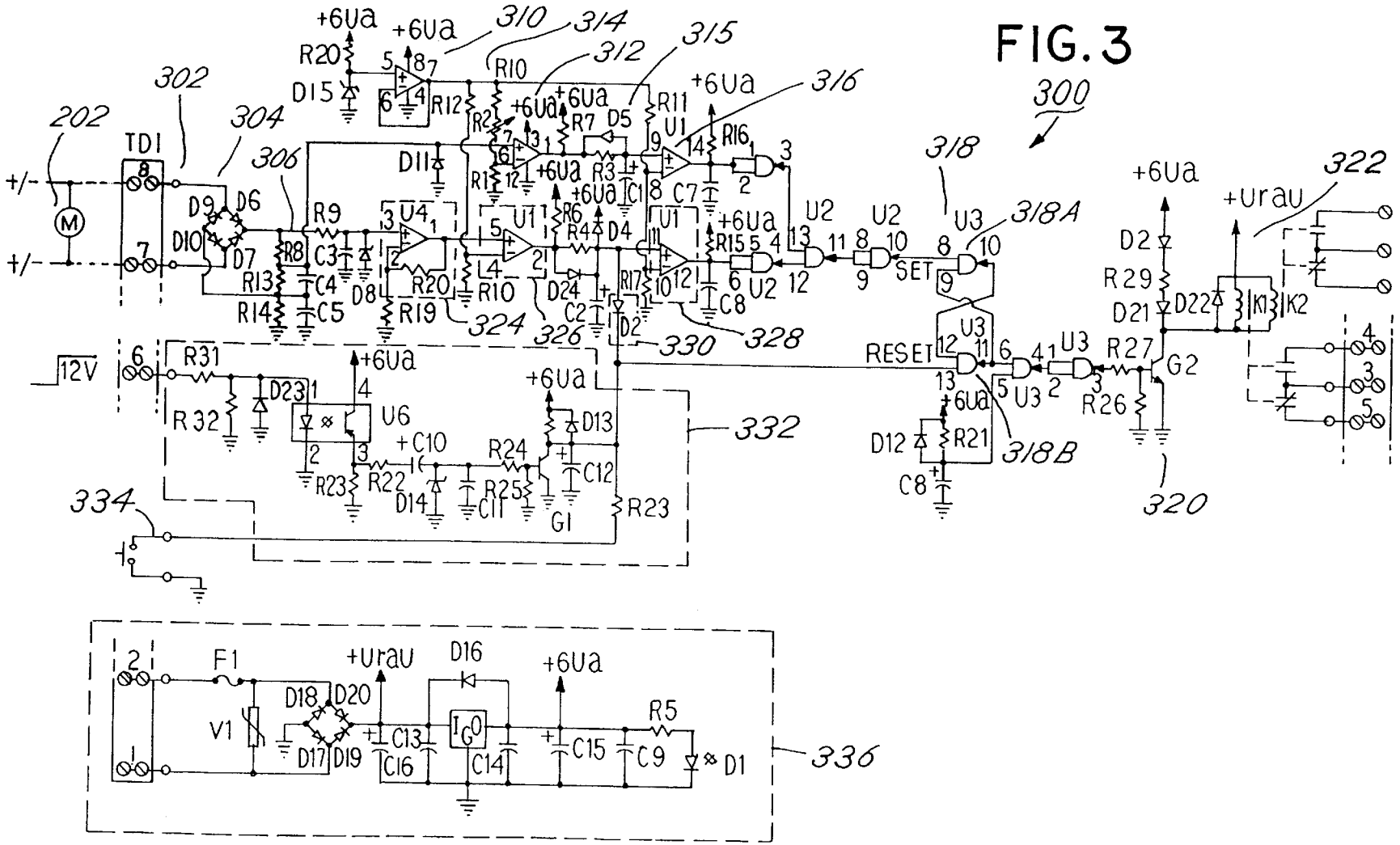
FIG. 3 is a simplified block diagram of an alternate embodiment of the invention implemented using a suitably programmed microprocessor.

FIG. 3 depicts a schematic diagram of the preferred embodiment of the gate motor armature speed or voltage sensor. With respect to FIG. 3, the armature contacts of the motor 202 are coupled to the input terminals of a bridge rectifier 304 through a pair of terminal contacts 302. Inasmuch as the output of the voltage generated by the motor 202, is not a pure D.C. level, the output of the bridge rectifier 304 is filtered by a R-C network to provide a substantially pure D.C. output voltage at nodes 306 and 308. A voltage comparator stage 312 compares the D.C. output voltage on node 308 with a fixed reference voltage developed by the voltage reference stage 310 as adjusted through a voltage divider network 314 the output level of which is used to determine if the motor 202 is generating power. The divider network 314 sets the threshold above which the output of the comparator 312 goes "on" or "active" thereby indicating that the D.C. voltage generated by the motor 202 indicates that the rotational speed of which has increased above a permissible rate. (The output voltage of the generator will be proportional to its rotational speed, as is well known in D.C. generator art.)

The comparator stage 312 shown in FIG. 3 is an "open collector" output as are the other voltage comparator circuits. Non-open-collector voltage comparator devices could be used as well however.

The environment in which the circuit of FIG. 3 operates is electrically noisy. An RC 315 network following the voltage comparator stage 312 filters transients that might be generated from the comparator stage 312 which are themselves generated by momentary over voltages at the motor's terminals such as those which might be caused by thumping or momentary motion of the gate arm by wind or pedestrians for example. The time constant of the low pass filter 315 following the comparator stage 312 is empirically determined so as to avoid false triggering of the subsequent logic stages, which act to apply a shunt impedance to the motor's armature.

A second comparator stage 316 provides additional buffering and determines when the output of the low pass filter stage 315 is high by comparing the output of the low pass filter stage to another reference voltage determined by resistors R11 and R17 as shown. When the output of the comparator stage 316 goes "high" or "active" (pulled up through a resistor to the supply voltage), combinational logic following comparator 316 sets latch 318 (comprised of two CMOS NAND gates 318A and 318B) turning on NPN transistor 322. Current through transistor 320 energizes the relay winding 320 causing the relay contacts in the relay 204 to change state. Changing the state of the relay contacts of relay 204 in FIG. 2 causes the application of the armature shunt impedance 212 across the gate motor armature contacts. When the motor, acting as a generator, sees an impedance across the armature, the motor becomes a dynamic brake for the gate arm mechanism, limiting its rate of travel by the value of the impedance.

In instances where the motor is powered and running, for instance, when the gate arm is being raised from a down position or being lowered from an up position, closing the contacts of relay 204 is preferably avoided because shunting an impedance across the powered motor would needlessly increase the electrical load on the motor power supply 210. Elsewhere in FIG. 3, gain stage 324 buffers and amplifies the output from bridge rectifier 304 and its own output is applied to comparator stage 326. Comparator 326 goes active (also known as "true") if the voltage developed across the armature of the motor, (after rectification and filtering) exceeds some adjustable predetermined threshold which is empirically determined to be a voltage at which the motor is energized and running, e.g. typically 15 volts or less if the motor 202 is denominated a 12-volt motor. Comparator 326 output is low-pass filtered to remove transients and noise spikes, so that its output can be evaluated by comparator 328.

If the output of comparator stage 328 is high or active, the motor 202 is determined to be energized and running, i.e., not acting as a generator, regardless of its rotational direction. The output of comparator 328 is buffered and tested against the output of the comparator stage 316 to determine if the motor is running. If the output of comparator stage 328 is true, the input to the NAND gate 318A will also be true. If the comparator stage 326 is true, diode 330 is forward biased and applies a logical one to the input of NAND gate 318-B causing its output to go to a logic zero. Those skilled in the art will recognize that when the output of NAND gate 318B is low, the transistor 320 is turned off. Thus when the motor is operating under power from the motor power supply 210, the relay 204 is precluded from applying the armature shunt impedance 212 and the motor is permitted to operate normally.

The state of the relay and contacts of relay 204 can be reset to a known state by power on reset circuitry 332 as well as a reset momentary push button switch 334.

The D.C. input power level is filtered, rectified and regulated by power supply circuitry 336 to provide lower-level voltage required by the active devices described above.

While those skilled in the art will recognize that the foregoing preferred embodiment is implemented with analog operational amplifiers and/or comparators with some combinational logic, an appropriately programmed microprocessor could achieve the same results as that realized by the circuitry of FIG. 3.

Figure 4:
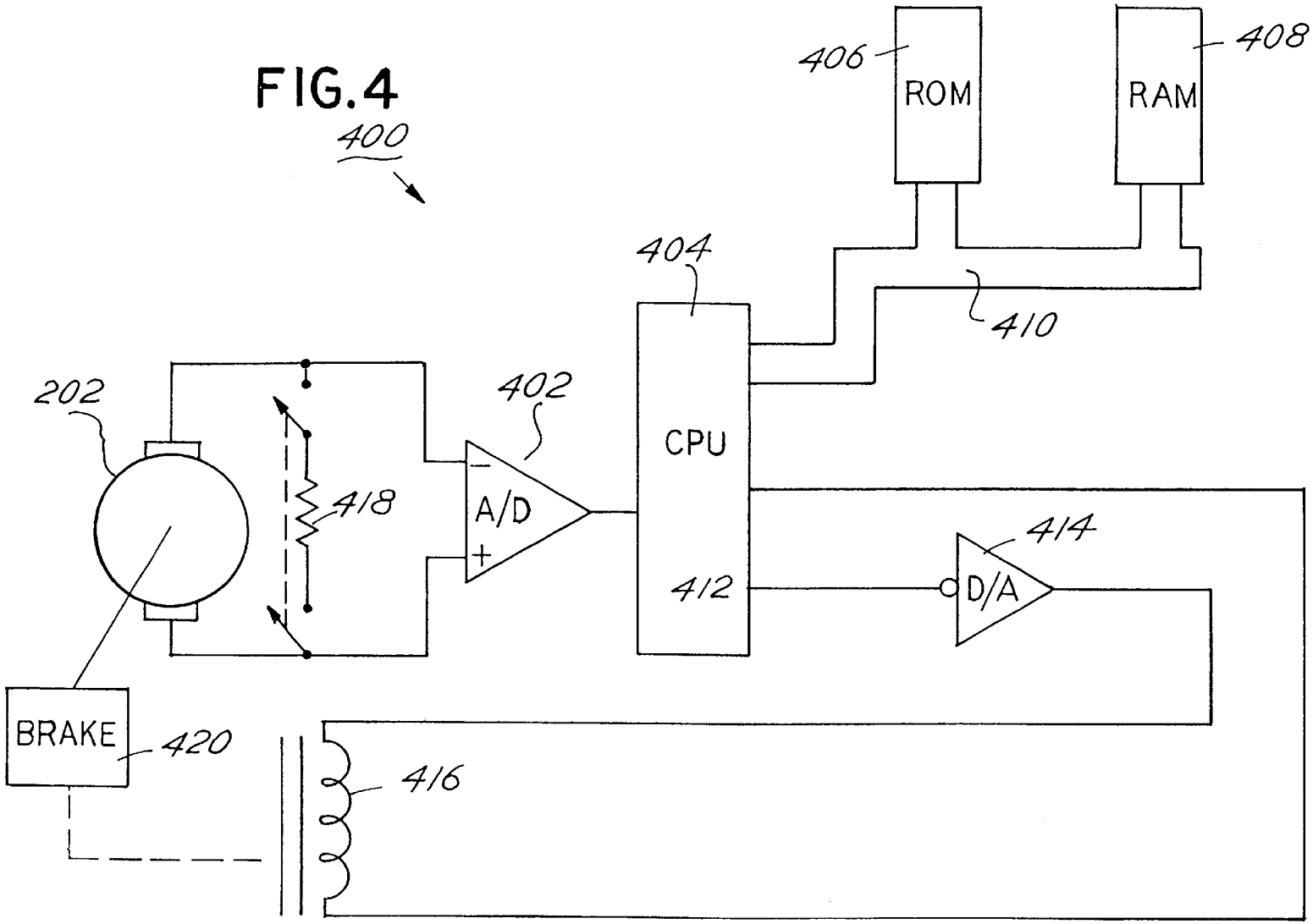
FIG. 4 is a simplified block diagram of a railroad crossing gate controller that provides bidirectional dynamic braking.

FIG. 4 depicts a simplified block diagram of a railroad crossing gate controller that provides bidirectional dynamic braking when a gate arm is suddenly accelerated upward, threatening the gate controller mechanical components. With respect to the circuit of FIG. 4, a D.C. gate motor 202, which would also be coupled to a motor power supply (not shown) has its output terminal voltage monitored by an analog-to-digital converter 402. (Many so-called single-chip microcontrollers include analog-to-digital converters accessible through all analog input port. An analog input voltage is thereby digitized by the CPU device itself) The function of the A/D 402 is precisely what its name suggests: to convert the analog D.C. voltage to a digital format recognizable by the central processing unit 404. Those skilled in the art will recognize that the CPU or computer 404 operates under the control of instructions and data preferably stored in a ROM 406 or RAM 408 which communicate with the CPU through address and control lines as well as a data bus collectively identified as by reference numeral 410. RAM 406 and/or ROM 408 can be comprised of separate semiconductor devices however, many commonplace microcontrollers also include on their substrates a substantial amount of such memory and if such a device were used the RAM and ROM in which program instructions and data would be stored might be considered part of the CPU 404. Of course, in the environment in which a railroad gate crossing mechanism is used, the CPU 404 might be subject to a considerable amount of electrical noise and temperature extremes.

The program under which the CPU 404 operates would, of course, require the determination of the terminal voltage across the motor 202 and a decision made when such voltage exceeds some threshold indicating that the motor is operating as a generator.

Relay 416 in the embodiment depicted in FIG. 2 would cause the connection of a shunt impedance 418 across the armature of the motor 202.

In an alternate embodiment, the relay 416 might actuate a mechanical brake 420 such as a frictional brake mechanism of viscose coupling mechanically linked to the armature so as to impede the rotation of the motor and brake the gate arm travel in either the up or down direction. A frictional or other mechanical brake 420 might also be used with the control circuit shown in FIGS. 2 and 3 as well.

The shunt impedance, depicted in FIGS. 2 and 4, is preferably a resistance although those skilled in the art will recognize that such an impedance might also be comprised of an inductance, a capacitance, and even a battery to create an electrical load into which the motor, acting as a generator, operates.

Dynamic braking a gate arm in both a downward direction and an upward direction is achieved by sensing the armature voltage of a D.C. motor so as to detect when such a D.C. motor begins acting as a generator. D.C. motors will generate an output voltage when they are rotated by an external mechanical power source. As is well known, the magnitude of an output voltage from a D.C. motor, acting as a generator, is directly proportional to the speed of the armature. Stated alternatively as the D.C. motor/generator rotates at increasingly higher speeds, the generated voltage will increase appropriately. Shunting the output of the D.C. generator with an impedance to Cause a current to flow through the armature will create a back EMF that opposes the rotation of the armature, dynamically braking further rotation and further increases in speed.

When the armature voltage of a D.C. motor, acting as a generator, exceeds some adjustable, predetermined threshold value, it can be assumed that when this output voltage threshold is achieved, the rotational speed of the motor is above the speed at which the voltage is generated. Shunting the armature of the generator with an impedance, dynamically brakes travel of the gate control arm mechanism effectively preventing the gate arm from being damaged and preventing the gate control mechanism, including the gearing and transmission and other mechanical components, from also being damaged by a counterweight accelerating downward or a gate arm accelerating downward uncontrollably.

Other, secondary operational benefits result from providing a motor armature voltage sensor.

In an "obstruction mode" of operation, motor power supply voltage and motor speed can be monitored and compared (sensed) while the gate is supposed to be rising. If during some predetermined period of time armature power is applied to the motor but without any motor rotation detected, the motor can be de-energized to prevent motor overheating, wiring and contact damage caused by a locked armature.

Gate arm "pumping" which is an oscillation of the gate arm caused by momentarily powering the motor can be avoided by way of an integrator, which monitors on-off cycles of the motor power. An accumulation (integration) of powered on-off cycles over time can be used to de-energize the motor protecting it from overheating and protecting mechanical components from repetitive mechanical shocks.

From the foregoing it can be seen that significant operational benefits can be realized by monitoring motor speed as well as zero motor speed in a gate control mechanism. Bi-directionally braking a gate arm can prevent mechanism damage that might be caused by sudden loss of a gate arm. Obstructions and gate arm pumping can also be reduced by monitoring armature voltage and locking the gate in place.

What is claimed is:

1. A railroad crossing gate control mechanism comprised of:

a gate motor for raising and lowering a railroad gate, said gate motor having first and second motor terminals;

a voltage or speed sensor having an input coupled to said motor terminals, said voltage or speed sensor detecting and being responsive to voltage levels present at said motor terminals indicative of when said gate motor acts as a generator, said voltage sensor having at least one output port and generating at said output port a first output signal if the voltage at said motor terminals is above a first threshold and generating a second output if the voltage at said motor terminals is above a second threshold;

a gate motor speed limiter coupled to said output port of said voltage sensor and to said gate motor, said gate motor speed limiter dynamically braking said gate motor by coupling an impedance across said motor terminals.

2. The railroad crossing gate control mechanism of claim 1 wherein said gate motor is a D.C. motor.

3. The railroad crossing gate control mechanism of claim 1 wherein said voltage sensor is comprised of a voltage amplitude sensor.

4. The railroad crossing gate control mechanism of claim 3 wherein said voltage amplitude sensor is comprised of an operational amplifier.

5. The railroad crossing gate control mechanism of claim 3 wherein said voltage amplitude sensor is comprised of a comparator.

6. The railroad crossing gate control mechanism of claim 1 wherein said voltage sensor is comprised of a motor-on voltage threshold detector circuit.

7. The railroad crossing gate control mechanism of claim 1 wherein said voltage sensor is comprised of a motor terminal voltage sensor and comparator circuit.

8. The railroad crossing gate control mechanism of claim 1 wherein said gate motor speed limiter is comprised of at least one relay which shunts said motor terminals together through an impedance.

9. The railroad crossing gate control mechanism of claim 1 wherein said gate motor speed limiter is comprised of at least one relay which shunts said motor terminals together through a resistor.

10. The railroad crossing gate control mechanism of claim 1 wherein said gate motor speed limiter is comprised of a latch circuit whereby said motor terminals are maintained in a short-circuit condition.

11. The railroad crossing gate control mechanism of claim 1 wherein said gate motor speed limiter is comprised of a latch circuit whereby said motor terminals are maintained in a short-circuit condition through a resistor.

12. The railroad crossing gate control mechanism of claim 1 wherein said impedance is comprised of a resistance.

13. The railroad crossing gate control mechanism of claim 1 wherein said impedance is comprised of a short-circuit.

14. The railroad crossing gate control mechanism of claim 1 wherein said impedance is comprised of an inductance.

15. The railroad crossing gate control mechanism of claim 1 wherein said impedance is comprised of a capacitance.

16. The railroad crossing gate control mechanism of claim 1 wherein said impedance is comprised of a battery.

17. The railroad crossing gate control mechanism of claim 1 wherein said voltage sensor includes at least one integrator for detecting a predetermined series of "on" signals to said motor prior to dynamically braking said motor.

18. The railroad crossing gate control mechanism of claim 1 wherein said voltage sensor is comprised of a microprocessor.

19. The railroad crossing gate control mechanism of claim 1 wherein said gate motor speed limiter is comprised of a microprocessor.

20. A railroad crossing gate control mechanism comprised of:

a gate motor for raising and lowering a railroad gate, said gate motor having first and second motor terminals;

a motor speed or voltage sensor, said motor speed or voltage sensor detecting and being responsive to motor speed, said motor speed or voltage sensor detecting and being responsive to motor zero speed and said motor speed or voltage sensor detecting and being responsive to a series of predetermined power applied, power removed signals to said motor prior to removing supply power and dynamically braking said motor, said speed or voltage sensor generating an output signal if any of the aforementioned conditions are detected; and a gate motor speed limiter coupled to said output port of said motor speed sensor and to said gate motor, said gate motor speed limiter dynamically braking said gate motor by coupling an impedance across said motor terminals.

21. The railroad crossing gate control mechanism of claim 20 wherein said gate motor is a D.C. motor.

22. The railroad crossing gate control mechanism of claim 20 wherein said motor speed sensor is comprised of a magnetic pickup.

23. The railroad crossing gate control mechanism of claim 20 wherein said motor speed sensor is comprised of a Hall effect sensor.

24. The railroad crossing gate control mechanism of claim 20 wherein said motor speed sensor is an optoelectronic speed sensor.

25. The railroad crossing gate control mechanism of claim 20 wherein said motor speed sensor is a resolver.

26. The railroad crossing gate control mechanism of claim 20 wherein said motor speed is a rotary variable differential transformer.

27. The railroad crossing gate control mechanism of claim 20 wherein said gate motor speed limiter is comprised of at least one relay which shunts said motor terminals together through an impedance.

28. The railroad crossing gate control mechanism of claim 20 wherein said gate motor speed limiter is comprised of at least one relay which shunts said motor terminals together through a resistor.

29. The railroad crossing gate control mechanism of claim 20 wherein said gate motor speed limiter is comprised of a latch circuit whereby said motor terminals are maintained in a short-circuit condition.

30. The railroad crossing gate control mechanism of claim 20 wherein said gate motor speed limiter is comprised of a latch circuit whereby said motor terminals are maintained in a short-circuit condition through a resistor.

31. The railroad crossing gate control mechanism of claim 20 wherein said impedance is comprised of a resistance.

32. The railroad crossing gate control mechanism of claim 20 wherein said impedance is comprised of a short-circuit.

33. The railroad crossing gate control mechanism of claim 20 wherein said impedance is comprised of an inductance.

34. The railroad crossing gate control mechanism of claim 20 wherein said impedance is comprised of a capacitance.

35. The railroad crossing gate control mechanism of claim 20 wherein said impedance is comprised of a battery.

36. The railroad crossing gate control mechanism of claim 20 wherein said voltage sensor includes at least one integrator for detecting said predetermined series of power applied, power removed signals to said motor prior to removing supply power and dynamically braking said motor.

37. The railroad crossing gate control mechanism of claim 20 wherein said speed sensor includes at least one integrator for detecting motor zero speed when supply power is applied for a predetermined length of time prior to removing supply power and dynamically braking said motor.

38. The railroad crossing gate control mechanism of claim 20 wherein said voltage sensor is comprised of a microprocessor.

39. The railroad crossing gate control mechanism of claim 20 wherein said gate motor speed limiter is comprised of a microprocessor.

40. A mechanism for raising and lowering a railroad crossing gate arm, said mechanism comprising:

a controller mechanism operatively connected to said railroad crossing gate arm for selectively raising and lowering said crossing gate arm;

said controller mechanism having a bi-directionally operative gate arm controller for sensing when said gate arm is being raised at a rate of speed in excess of an adjustable predetermined rate of speed;

said bi-directionally operative gate arm controller further sensing when said gate arm is being lowered at a rate of speed in excess of an adjustable predetermined rate of speed; and said controller mechanism having means for dynamically braking both said raising rate of speed and said lowering rate of speed of said gate arm when said gate arm controller senses either said excessive raising rate of speed or said excessive lowering rate of speed.

41. The mechanism of claim 40 wherein said dynamic braking means comprises a D.C. motor.

42. In a crossing gate control mechanism having a D.C. motor with an armature for raising and lowering a gate arm, a method of bi-directionally dynamically braking both the raising and lowering of said crossing gate arm by said gate control mechanism comprising the steps of:

sensing the voltage of said armature of said D.C. motor when said gate arm is raising and when said gate arm is lowering; and when said voltage of said armature of said D.C. motor exceeds an adjustable predetermined threshold rate of speed when said gate arm is raising or lowering thereby indicating said D.C. motor is acting as a generator, then shunting said armature of said D.C. motor with an impedance to cause said D.C. motor to dynamically brake the rotation of said armature in both said raising and lowering directions of said gate arm, thereby dynamically braking the raising or lowering of said gate arm.

* * * * *